US005823459A

United States Patent [19]

York

[11] Patent Number: 5,823,459

[45] Date of Patent: Oct. 20, 1998

[54] DEVICE FOR REWINDING USED HEAT TRANSFER FOIL

[76] Inventor: Rick York, Rte. 1, Box 43, Kellyville, Okla. 74039

[21] Appl. No.: 832,280

[22] Filed: Apr. 3, 1997

[51] Int. Cl.[6] ..... B65H 18/08

[52] U.S. Cl. ..... 242/471; 242/158.3

[58] Field of Search ..... 242/158.3, 471

[56] References Cited

U.S. PATENT DOCUMENTS

| | | | |
|---|---|---|---|
| 1,267,080 | 5/1918 | Judelshon | 242/471 |
| 1,588,995 | 6/1926 | Ruf | 242/471 |
| 1,867,596 | 7/1932 | Roseman | 242/471 |
| 2,324,329 | 7/1943 | Shoffner | 242/158.3 |
| 2,692,738 | 10/1954 | Seaman | 242/158.3 |
| 3,140,839 | 7/1964 | Whitecar | 242/471 |
| 3,309,066 | 3/1967 | Carlson et al. | 242/158.3 X |
| 3,533,575 | 10/1970 | Laky | 242/158.3 |
| 4,005,834 | 2/1977 | Landreau | 242/158.3 |
| 4,150,801 | 4/1979 | Ikegami et al. . | |
| 4,235,394 | 11/1980 | Fry . | |
| 4,352,467 | 10/1982 | Dunn et al. | 242/471 |
| 4,413,792 | 11/1983 | O'Connor | 242/471 |
| 4,623,100 | 11/1986 | Tremblay . | |
| 4,629,145 | 12/1986 | Graham . | |
| 4,645,135 | 2/1987 | Morris et al. . | |
| 4,756,489 | 7/1988 | De Varennes . | |
| 4,767,073 | 8/1988 | Malzacher | 242/158.3 X |
| 4,802,636 | 2/1989 | Frick et al. . | |
| 4,884,764 | 12/1989 | Hill . | |

FOREIGN PATENT DOCUMENTS

| | | | |
|---|---|---|---|
| 97966 | 6/1984 | Japan | 242/158.3 |
| WO 92/04139 | 3/1992 | WIPO | 242/158.3 |

*Primary Examiner*—Donald P. Walsh
*Assistant Examiner*—William A. Rivera
*Attorney, Agent, or Firm*—Molly D. McKay

[57] ABSTRACT

A device for rewinding used heat transfer foil onto an empty takeup spool so that heat transfer foil can be easily, compactly and cleanly disposed. The device is provided with a rotating takeup spool onto which the used heat transfer foil is wound. The used heat transfer foil is guided onto the takeup spool in an orderly sequence by a reciprocating arm of a travelling guide block which moves parallel to the takeup spool and travels in unison with rotation of the spool. The power train which powers rotation of the takeup spool and reciprocation of the arm is provided with a slip-type clutch disk which allows the takeup spool to speed up, slow down, and stop and start rotating in response to availability of used heat transfer foil.

6 Claims, 2 Drawing Sheets

DEVICE FOR REWINDING USED HEAT TRANSFER FOIL

BACKGROUND OF THE INVENTION

1. Field of the Invention

The present invention relates to a device for holding an takeup spool and rewinding used heat transfer foil onto the takeup spool in order to facilitate disposal of the used heat transfer foil.

2. Description of the Related Art

Heat transfer foil is employed in imprinting external surfaces of such things as plastic pipe and electrical cable. The heat transfer foil generally is in the form of a continuous cellophane tape. The cellophane tape is provided with a backing which contains a particulate matter which forms the print when properly applied to the desired surface. This backing is preferably of a contrasting color to the color of the surface to which the print is applied. For example, heat transfer foil with a blue backing is often used to imprint the surface of white pipe.

After the heat transfer foil has been used to imprint a surface, it must be disposed. One problem associated with disposing of the used foil is that part of the particulate matter forming the backing is not used when a surface is imprinted and thus remains on the used foil. This remaining particulate matter is easily dislodged and can create a dusty mess, creating both air pollution problems and possibly a fire hazard. Another problem associated with disposing of the used foil is that the cellophane tape is fragile and will break easily if placed under sufficient tension. If the used heat transfer foil is deformed by stretching, the particulate matter forming the backing dislodges and separates from the cellophane tape. If the used heat transfer tape is stretched to its breaking point, a plurality of pieces of particulate matter from the backing are flipped into the air, creating the dusty mess previously described; both in the air and on the surrounding surfaces onto which these pieces of particulate matter ultimately come to rest after drifting through the air. Also if the cellophane tape is broken, the broken pieces of cellophane are also light in weight and can present disposal challenges due to their large volume and tendency of the individual pieces to blow around.

The current most widely employed means of disposing of used heat transfer tape is to vacuum the foil into a vacuum system. One problem with vacuuming the foil is that this causes the cellophane tape to undergo severe mechanical abrasion which dislodges the particulate matter into the vacuum system from which it must later be removed in particulate or powder form. Also, because the used heat transfer tape is pulled into the vacuum system in a random, disorganized manner, the cellophane tape forms a loose mass, creating a large volume of waste which must later be removed from the vacuum system and disposed. Disposal of this large volume of cellophane tape is complicated by the fact that the particulate matter is now loosely included in the mass which must be disposed.

The present invention addresses the problem of disposal of used heat transfer tape by providing a device capable of rewinding the used tape onto an empty spool. The device of the present invention further prevents the tape from undergoing mechanical stress which would cause the backing to separate from the cellophane tape. Thus, the device is able to rewind the intact used heat transfer tape onto a takeup spool which was one of the spools onto which the tape was wound when it was newly purchased. Thus, use of the present device prevents the problems associated with disposal of used empty spools, dislodged particulate matter and loosely aggregated cellophane tape while reducing the total volume of waste which must be disposed.

The device is able to accomplish this job by varying the speed of rotation of its takeup spool to coincide with the speed at which used heat transfer tape is produced. The device is able to vary the speed of rotation of its takeup spool without exerting an undue pulling force on the used heat transfer tape which is being rewound onto the takeup spool.

SUMMARY OF THE INVENTION

The present invention is a level wind device for winding used heat transfer foil onto an empty takeup spool. In a heat transfer process involving heat transfer of characters onto a surface to be imprinted, such as for example the surface of a pipe, unused heat transfer foil is unrolled from a new roll of unused heat transfer foil and fed between a heat transfer device and the surface to be imprinted in order to imprint characters onto the surface. The used heat transfer foil then is fed to the level wind device. The used foil first passes through an eye provided on a horizontal arm on a travelling guide block of the level wind device before being wound onto a rotating, empty takeup spool removably attached to the level wind device via a spool shaft.

The level wind device is provided with a base upon which the device rests. A hollow upright support member secures to and extends upward at approximately a right angle from the base. A threaded first end of the spool shaft rotatably extends through one wall of the hollow upright support member via a first shaft bearing and a threaded second end of the spool shaft rotatably extends through an opposite wall of the hollow upright support member via a second shaft bearing. The threaded first end of the spool shaft is rotatably secured to the upright support member via a first knurled nut which engages and is tightened onto the threaded first end of the spool shaft so that the first knurled nut abuts the first shaft bearing.

The takeup spool is provided with a central spool opening which extends from a first flanged end of the takeup spool, longitudinally through the takeup spool, and ends at a second flanged end of the takeup spool. The spool opening allows the takeup spool to be removably inserted onto the spool shaft via its second flanged end so that the threaded second end of the spool shaft extends outward beyond the first flanged end of the takeup spool. A second knurled nut engages and is tightened onto the threaded second end of the spool shaft so that the second knurled nut abuts the first flanged end of the takeup spool and secures the takeup spool thereon.

A coiled spring is disposed around the spool shaft and is compressed between the second shaft bearing and a second flanged end of the takeup spool in order to cause the takeup spool to be tensioned between the second knurled nut and the coiled spring.

Within the hollow upright support member, a spool sheave is secured to the spool shaft so that they rotate together. A belt extends around the spool sheave and also extends around a pressure plate which is also located within the hollow upright support member such that whenever the pressure plate rotates, the belt, the spool sheave the spool shaft, and the attached takeup spool also rotate.

The pressure plate secures to a first end of a rotatable traverse rod. A second end of the traverse rod extends outward through a first bearing into a hollow horizontal support member. A proximal end of the horizontal support member is secured to the upright support member approximately perpendicularly to a longitudinal axis of the upright support member.

The second end of the traverse rod is rotatably received by a second bearing provided in a distal end of the horizontal support member so that the longitudinal axis of the traverse rod is approximately perpendicular to the longitudinal axis of the upright support member.

The proximal end of the horizontal support member is provided with a female threaded opening therethrough. Male threads on a tension screw engage the female threaded opening, allowing the tension screw to push the traverse rod and the attached pressure plate toward the upright support member when a knurled head which is located external to the horizontal support member and secured on the tension screw is rotated.

When the tension screw pushes against the pressure plate, the pressure plate more tightly engages a clutch disk which is provided on a clutch plate. The clutch plate is attached to a drive shaft which enters the hollow upright support member from an electric motor located adjacent to the upright support member. The drive shaft enters the upright support member via a drive shaft opening provided in a wall of the hollow upright support member. The drive shaft passes through a drive bearing located within the upright support member located adjacent to and aligned with the drive shaft opening. An electrical cord supplies the electric motor with electricity from a power source.

A central portion of the traverse rod is provided with double threads machined into the traverse rod. The travelling guide block is provided with a movable vane which extends inwardly and travels within the double threads causing the travelling guide block to travel horizontally between a first end and an opposite second end of the double threads and causing the travelling guide block to reverse direction of travel automatically when reaching one of the ends of the double threads.

The travelling guide block is provided with a horizontal arm which extends outward through a horizontal slot provided in a side wall of the horizontal support member.

DETAILED DESCRIPTION OF THE PREFERRED EMBODIMENT

Figure 1:
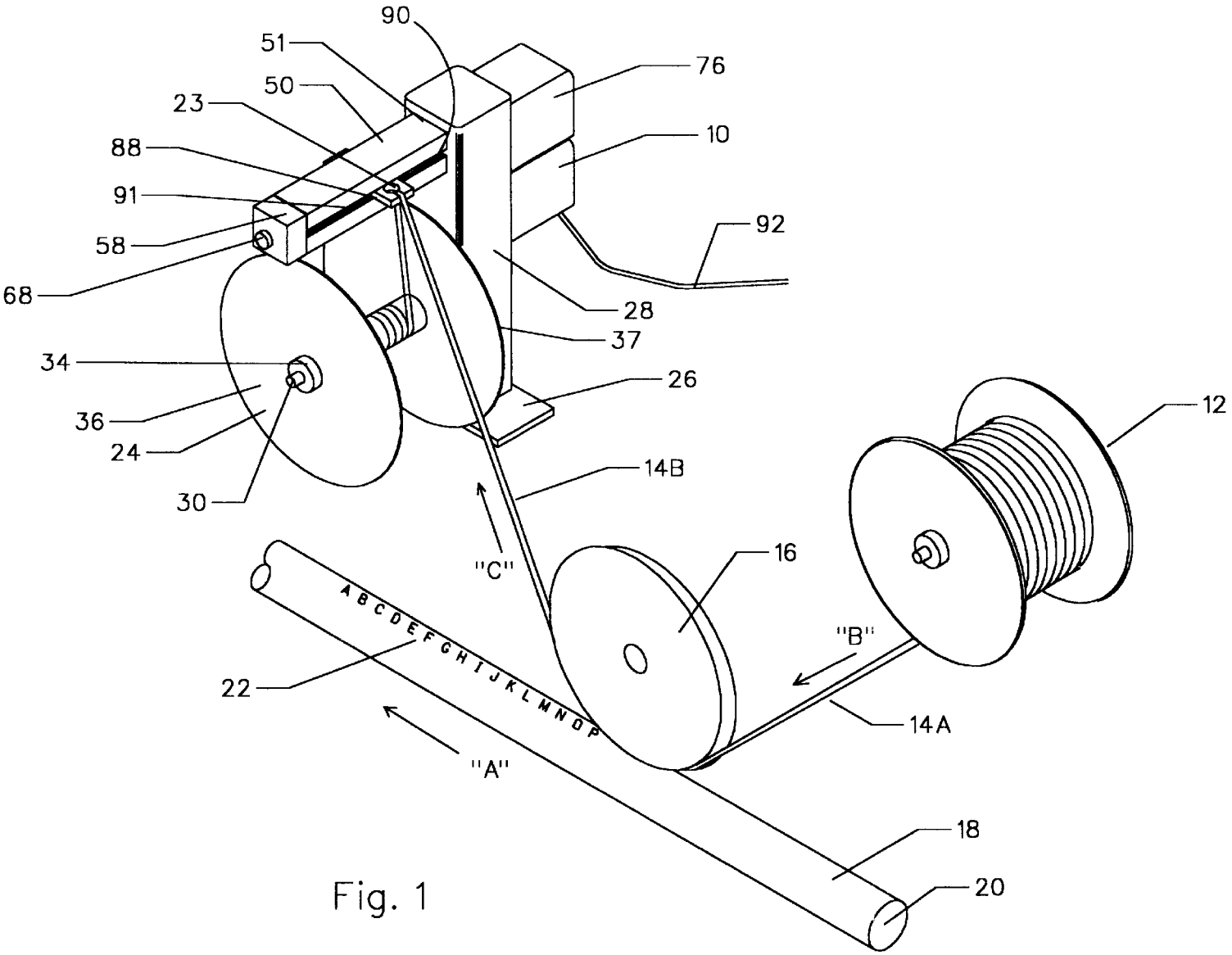
FIG. 1 is a partially cut away front perspective view of the level wind device shown being used to rewinding onto a takeup spool heat transfer foil which has been previously used to imprint a surface.

Referring now to the drawings and initially to FIG. 1, there is illustrated a level wind device 10 constructed in accordance with a preferred embodiment of the present invention. Also, illustrated in FIG. 1 is a new roll 12 of unused heat transfer foil 14A which becomes used heat transfer foil 14B upon passing between a heat transfer device 16 and a surface 18 to be imprinted, such as for example the external surface 18 of a pipe 20, as illustrated in FIG. 1. As shown in FIG. 1, in order for the surface 18 to be imprinted with characters 22, the pipe 20 must travel in the direction of Arrow "A" and the new and used heat transfer foil 14A and 14B must travel in the direction of Arrows "B" and "C", respectively, relative to the heat transfer device 16.

After the used heat transfer foil 14B disengages the heat transfer device 16, it travels to the device 10, and specifically, passes through an eye 23 provided on a travelling guide block 25 before being wound onto a takeup spool 24.

Figure 2:
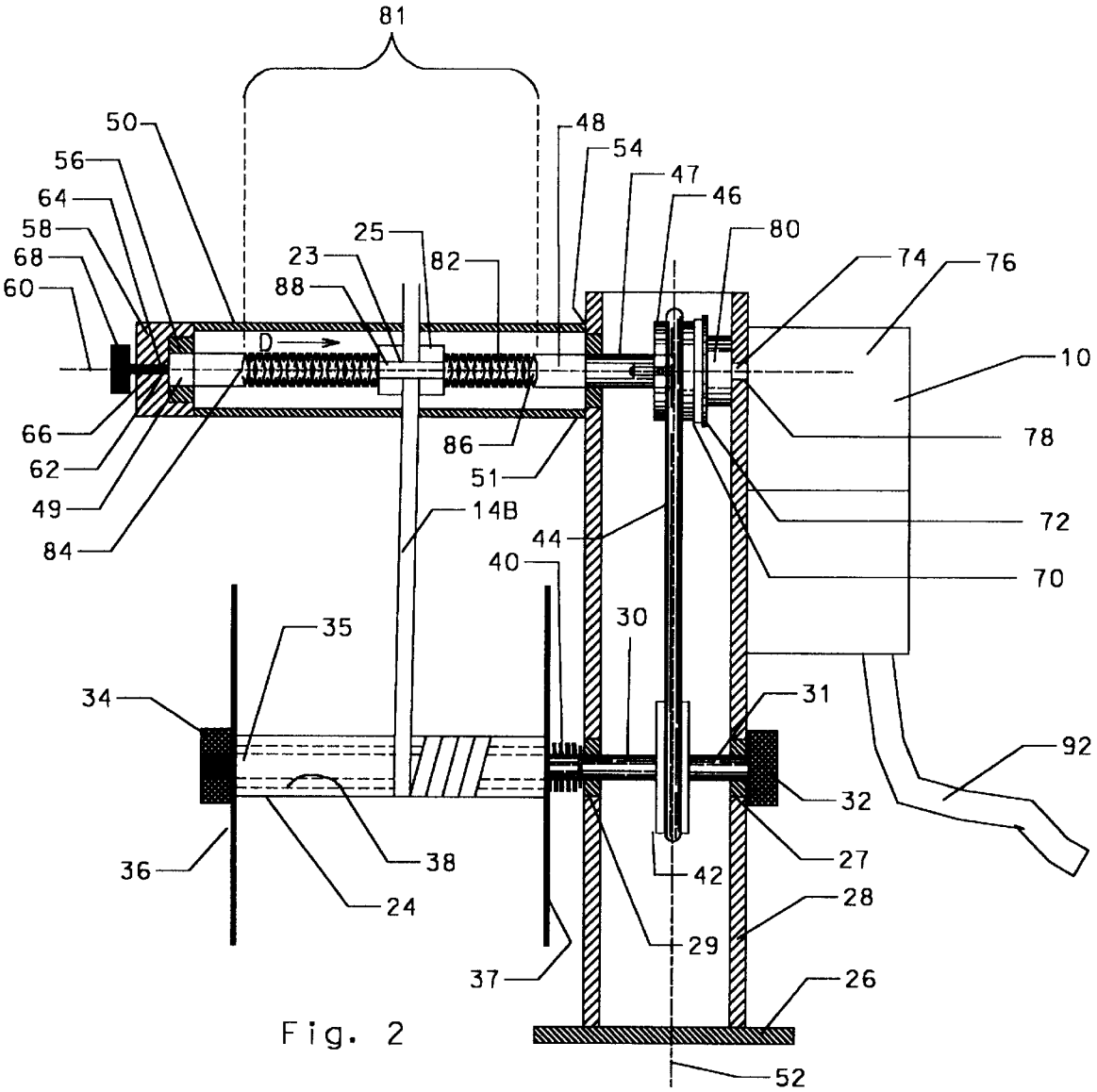
FIG. 2 is a partially cut away front elevation of the level wind device of FIG. 1.

Referring now to FIG. 2, the device 10 is illustrated in greater detail. The device 10 is provided with a base 26 on which the device 10 rests upon a horizontal surface (not shown). Attached perpendicularly to the base 26 and extending upward therefrom, is a hollow upright support member 28 for supporting the various components of the device 10.

A spool shaft 30 extends through the hollow upright support member 28 and projects outward approximately horizontally from the upright support member 28 to which it rotatably attaches. The spool shaft 30 extends through one side of the hollow upright support member 28 via a first shaft bearing 27 and extends out an opposite side of the upright support member 28 via a second shaft bearing 29, as illustrated in FIG. 2. The spool shaft 30 is held in place on a threaded first end 31 with a first knurled nut 32 which removably engages the threaded first end 31 so that the first knurled nut 32 abuts the first shaft bearing 27 and the upright support member 28.

An opposite threaded second end 35 of the spool shaft 30 is provided with a removable second knurled nut 34 which removably engages the threaded second end 35 so that the second knurled nut 34 abuts a flanged first end 36 of the removable takeup spool 24. The takeup spool 24 inserts onto the spool shaft 30 by means of a spool opening 38 provided centrally within the takeup spool 24 and extending from the first end 36 to a second flanged end 37.

A coiled spring 40 is disposed around the spool shaft 30 so that the spring 40 is located between the second end 37 of the takeup spool 24 and the upright support member 28. The coiled spring 40 is compressed between the second end 37 of the takeup spool 24 and the upright support member 28 when either the second knurled nut 34 is tightened onto the threaded second end 35 or, alternately, the first knurled nut 32 is tightened onto the threaded first end 31. The compressed coiled spring 40 biases the takeup spool 24 toward the second knurled nut 34 and thereby creates friction therebetween. This friction tends to cause the takeup spool 24 to rotate in unison with rotation of both the spool shaft 30 and the attached second knurled nut 34. The takeup spool 24 will continue to rotate in unison with rotation of the spool shaft 30 and the second knurled nut 34 unless a braking force in excess of this frictional force is applied to the takeup spool 24, such as, for example, a braking force which could be applied to the takeup spool by the used heat transfer foil 14B which is being wound onto the takeup spool 24.

A spool sheave 42 is provided within the hollow upright support member 28 and is secured to the spool shaft 30 so that the spool shaft 30 rotates in unison with rotation of the spool sheave 42. A belt 44 extends around the spool sheave 42 and also extends around a pressure plate 46 also located within the hollow upright support member 28 so that as the pressure plate 46 rotates, the belt 44 is caused to travel around the pressure plate 46. Travel of the belt 44 around the pressure plate 46, in turn, causes the spool sheave 42 to rotate in unison with rotation of the pressure plate 46. Likewise, rotation of the spool sheave 42 causes the spool shaft 30 and the takeup spool 24 to rotate.

The pressure plate 46 is secured to a first end 47 of traverse rod 48. The traverse rod 48 extends through the hollow upright support member 28 and projects outward approximately horizontally from the upright support member 28 to which it rotatably attaches. A second end 49 of the traverse rod 48 extends outward from the support member 28, through a horizontal support member 50. The horizontal support member 50 is secured on a proximal end 51 to the upright support member 28 and extends approximately perpendicular to a longitudinal axis 52 of the upright support member 28.

The traverse rod 48 is provided with a first bearing 54 at the proximal end 51 of the horizontal support member 50 and with a second bearing 56 at a distal end 58 of the horizontal support member 50. The traverse rod 48 freely rotates within the horizontal support member 50 on the bearings 54 and 56 and along a longitudinal axis 60 of the traverse rod 48.

The distal end 58 of the horizontal support member 50 is provided with a female threaded opening 62 so that the opening 62 aligns with the longitudinal axis 60. Male threads 64 provided on a tension screw 66 engage the female threaded opening 62, thus allowing the tension screw 66 to move inward and outward relative to the second end 49 of the traverse rod 48. When a knurled head 68 of the tension screw 66 is rotated so that the tension screw 66 moves toward the traverse rod 48, the tension screw 66 engages the second end 49, thus forcing the traverse rod 48 to move horizontally within the bearings 54 and 56, as illustrated in FIG. 2 by Arrow "D".

When the traverse rod 48 moves horizontally in the direction of Arrow "D", the pressure plate 46, which is secured to the first end 47 of the traverse rod 48, also moves in the same direction, forcing the pressure plate 46 into a tight engagement with a clutch disk 70 which lies between the pressure plate 46 and a clutch plate 72 located adjacent to the clutch disk 70. The clutch plate 72 is rotated by a drive shaft 74. The drive shaft 74 extends from an electric motor 76, through a drive shaft opening 78 provided in the hollow upright support member 28, through a drive bearing 80 which is secured within the hollow upright support member 28, and finally secures to the clutch plate 72. Thus, the clutch plate 72 rotates in conjunction with the drive shaft 74.

When the tension screw 66 forces the traverse rod 48 and the attached pressure plate 46 in the direction of Arrow "D", this forces the pressure plate 46 into tighter engagement with the clutch disk 70, which is secured to and rotates in conjunction with the clutch plate 72. The tighter the pressure plate 46 engages the clutch disk 70 the more friction is created between the pressure plate 46 and the clutch disk 70. When friction between the pressure plate 46 and clutch disk 70 is sufficient, the pressure plate 46 and attached traverse rod 48 will rotate with the clutch disk 70 and clutch plate 72.

On the other hand, if the pressure plate 46 and traverse rod 48 are rotating with the clutch disk 70, rotation of the pressure plate 46 and traverse rod 48 can be stopped by applying sufficient braking force on the travelling guide block 25 and on the takeup spool 24, as will be more fully described hereafter.

A central portion 81 of the traverse rod 48 is provided with double threads 82 machined into the traverse rod 48. The travelling guide block 25 is movably provided with an inwardly extending vane (not illustrated) which travels within the double threads 82, thus causing the travelling guide block 25 to travel horizontally along the double threads 82 of the traverse rod 48 as the traverse rod 48 rotates. When the travelling guide block 25 reaches a first end 84, the vane (not illustrated) rotates slightly, thus causing the travelling guide block 25 to automatically reverse its direction of travel 180°. The travelling guide block 25 will then travel toward a second end 86 of the double threads 82. Likewise, then the travelling guide block 25 reaches the second end 86 of the double threads 82, the vane (not illustrated) will again rotate slightly, thus again causing the travelling guide block 25 to automatically reverse its direction of travel 180°. The movable vane (not illustrated) in conjunction with the double threads 82 permit the travelling guide block 25 to repeatedly automatically reverse its direction of travel without changing the direction of rotation of the traverse rod 48.

As illustrated in FIGS. 1 and 2, the travelling guide block 25 is provided with a horizontal arm 88 which extends outward through a horizontal slot 90 provided in a side wall 91 of the horizontal support member 50. A portion of the arm 88 which extends beyond the horizontal support member 50 is provided with the eye 23 extending therethrough from top to bottom. As shown in the drawings, used heat transfer foil 14B which is travelling away from the heat transfer device 16, first passes downwardly through the eye 23 before being wound onto the takeup spool 24.

The purpose of the traveling guide block 25 is to direct the used heat transfer foil 14B onto the takeup spool 24 so that in each turn of the takeup spool 25, the used heat transfer foil 14B is slightly displaced horizontally so that the used foil 14B is evenly wound onto the takeup spool in a spiral configuration.

When the used transfer foil 14B approaches either the first or second end 36 or 37 of the takeup spool 25, the travelling guide block 25 reaches either the first or second end 84 or 86 of the double threads 82, and reverses its travel 180°. This reversal of direction of travel of the travelling guide block 25 causes the used heat transfer foil 14B to be wound onto the takeup spool 24 in a spiral configuration which is a mirror image of the spiral configuration in which the used heat transfer foil 14B was wound onto the takeup spool 24 during the opposite travel of the traveling guide block 25.

By winding the used heat transfer foil 14B onto the takeup spool 24 in these orderly, alternating spiral configurations, as described above, the device 10 maximizes the amount of used heat transfer foil 14B which can be wound onto a given takeup spool 24.

OPERATION

The used heat transfer foil 14B is first fed downwardly through the eye 23 and is attached, by tape, glue or other suitable means to an empty takeup spool 24. When feeding the used heat transfer foil 14B through the eye 23, the foil 14B is preferably oriented so that the side of the foil 14B to which the backing of particulate matter has been applied, does not touch the horizontal arm 88 as the foil 14B passes through the eye 23. If the backing of the used foil 14B were allowed to touch the arm 88 as the used foil 14B passed through the eye 23, the particulate matter comprising the backing on the used foil 14B might be scraped off or otherwise dislodged from the used foil 14B.

When the device 10 is activated, the electric motor 76 receives electricity from a power source (not illustrated) via an electrical cord 92, causing the motor 76 to rotate the drive shaft 74 and the attached clutch plate 72 and clutch disk 70. The knurled head 68 on the tension screw 66 is then rotated to adjust the tension on the traverse rod 48 so that it exerts just enough pressure on the traverse rod 48 and attached pressure plate 46 to cause the traverse rod 48 and the pressure plate 46 to rotate in conjunction with the rotation of the clutch disk 70.

Rotation of the traverse rod 48 causes the travelling guide block 25 to move horizontally between the first and second ends 84 and 86 of the double threads 82 provided on the traverse rod 48.

Rotation of the pressure plate 46 causes the belt 44, the spool sheave 42, the spool shaft 30 and the takeup spool 24 to also rotate.

Because the traverse rod 48 operates the travelling guide block 25 which guides the used heat transfer foil 14B as it is wound onto the takeup spool 24, it is important that the rotation of the traverse rod 48 be in coordination with rotation of the takeup spool 24. Likewise, it is important that when the takeup spool 24 stops rotating, that the traverse rod 48 also stops rotating. Further, it is important that the takeup spool 24 rotate at a sufficient speed to keep a slight tension on the used heat transfer foil 14B. This tension is needed in order to prevent excess loops of used heat transfer foil 14B from forming between the heat transfer device 16 and the eye 23 or between the eye 23 and the takeup spool 24. However, it is equally important that the tension on the used heat transfer foil 14B not be great enough to stretch the used heat transfer foil 14B and, thus, dislodge the remaining particulate matter forming the backing on the used heat transfer foil 14B nor to break the used heat transfer foil should for some reason the used heat transfer foil 14B stop travelling in the direction of Arrow "C" or should it reduce its rate of travel in the direction of Arrow "C". Thus, the speed of rotation of the takeup spool 24 and the traverse rod 48 must closely coordinate with the rate of travel of the used heat transfer foil 14B in the direction of Arrow "C". This is accomplished by the operation of pressure plate 46 and the clutch disk 70.

Obviously, although the electric motor 76 turns at a relatively slow rate, it provides a much higher rate of rotation or revolutions per minute (RPM) to the drive shaft 74, clutch plate 72 and the clutch disk 70 than is needed or is normally desired for the takeup spool 24 and the traverse rod 48. The clutch disk 70 acts as a slip clutch and while it continually rotates, the pressure plate 46 may either rotate at the same speed as the clutch disk 70, not rotate at all, or rotate at some speed less than the speed of rotation of the clutch disk 70. Whether or not the pressure plate 46 rotates, and also the speed of that rotation, is determined by the pressure adjustment of the tension screw 66 and the braking force applied by the used heat transfer foil 14B due to the fact that the travel speed in the direction of Arrow "C" for the used heat transfer foil 14B is less than the speed at which the electric motor 76 is capable of rotating the takeup spool 24.

Thus, the present device 10 can easily stop and start rotation of the takeup spool 24, and can increase or decrease the speed of rotation of the takeup spool 24 in response to availability and speed of used heat transfer foil being produced in a heat transfer process.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A device for rewinding used heat transfer foil comprising:

means for rotatably holding a spool, means for guiding used heat transfer foil onto said spool so that the heat transfer foil is wound onto said spool in an orderly fashion, means for guiding used heat transfer foil onto said spool being coordinated in its rotation with rotation of movement of said means for rotatably holding said spool, a motor attached via a slip drive mechanism to said means for rotatably holding said spool and attached via the slip drive mechanism to said means for guiding used heat transfer foil onto said spool, a tensioning screw being provided on said means for guiding used heat transfer foil in order to increase and decrease friction between said slip drive mechanism and said means for guiding used heat transfer foil onto a spool, wherein said spool is removably secured to said means for rotatably holding said spool, wherein said slip drive mechanism further comprises a rotatable drive shaft attached to said motor, a clutch plate secured to said drive shaft, a clutch disk provided on said clutch plate for frictional engagement with a pressure plate provided on said means for guiding used heat transfer foil onto a spool.

2. A device according to claim 1 wherein said means for guiding used heat transfer foil onto a spool further comprises a rotatable traverse rod, said pressure plate provided on one end of said traverse rod for frictional engagement with said clutch plate, a travelling guide block movably secured to said traverse rod so that the travelling guide block travels back and forth along a longitudinal axis of the traverse rod as the traverse rod rotates, said travelling guide block being provided with an eye through which heat transfer foil passes before being wound onto the spool.

3. A device according to claim 2 wherein said means for rotatably holding a spool further comprises a spool shaft, a spool sheave secured to one end of said spool shaft, a belt engaging both said spool sheave and said pressure plate, and means to removably secure the spool to the spool shaft being provided on an opposite end of said spool shaft.

4. A device according to claim 3 further comprising support means for rotatably holding said traverse rod approximately parallel with said spool shaft.

5. A device for winding a continuous strip onto a spool comprising a support member, a spool shaft rotatably secured approximately horizontally to said support member, means for removably securing a spool onto said spool shaft being provided on one end of said spool shaft, a traverse rod rotatably secured to said support member so that said traverse rod is approximately parallel with said spool shaft, a travelling guide block movably engaging said traverse rod so that said travelling guide block moves longitudinally back and forth on said traverse rod as said traverse rod rotates, a motor secured to said support member, a drive shaft rotatably secured on one end to the motor and secured on an opposite end to a clutch disk, a pressure plate secured to one end of said traverse rod for frictional engagement with said clutch disk, a tensioning screw in movably engagement with an opposite end of said traverse rod for regulating frictional engagement of said pressure plate with said clutch disk, belt means engaging said pressure plate and engaging a spool sheave provided on a second end of said spool shaft.

6. A device according to claim 5 further comprising a spool removably secured onto said spool shaft, and a horizontal arm provided on and extending outward from said travelling guide block, said horizontal arm being provided with an eye through which a strip passes before being wound onto the spool.

* * * * *